United States Patent [19]

Sakshaug

[11] 3,936,703

[45] Feb. 3, 1976

[54] GAS-INSULATED ELECTRIC POWER APPARATUS INCLUDING A SURGE ARRESTER WITH HOT GAS RELIEF MEANS

[75] Inventor: Eugene C. Sakshaug, Lanesborough, Mass.

[73] Assignee: General Electric Company, N.Y.

[22] Filed: July 11, 1974

[21] Appl. No.: 487,656

[52] U.S. Cl. ..... 317/62; 317/72

[51] Int. Cl.[2] ..... H02H 9/06

[58] Field of Search ..... 317/62, 71, 72, 59, 61; 315/36; 313/155, 156, 157

[56] References Cited

UNITED STATES PATENTS

| | | | |
|---|---|---|---|
| 3,518,483 | 6/1970 | Eason et al. | 315/36 |
| 3,624,450 | 11/1971 | Graybill | 317/62 |
| 3,644,791 | 2/1972 | Carothers et al. | 315/36 X |
| 3,777,218 | 12/1973 | Kessler | 317/62 X |

*Primary Examiner*—James D. Trammell
*Attorney, Agent, or Firm*—Volker R. Ulbrich

[57] ABSTRACT

A voltage surge arrester disposed in a metal enclosure pipe containing an insulating gas is provided with a gas vent adjacent the line voltage terminal end of the arrester for venting gases which are generated inside the arrester. The vent is directed toward, and is in close proximity to, the inside surface of the metal housing. Upon failure of the arrester, the venting establishes a short circuit at the arrester line terminal, which both initiates the operation of a protective current interruption device elsewhere in the system and instantly diverts fault current from the arrester itself. As a result, fracturing of the porcelain, which would otherwise result from further pressure buildup in the arrester or from thermal shock, is avoided.

1 Claim, 2 Drawing Figures

GAS-INSULATED ELECTRIC POWER APPARATUS INCLUDING A SURGE ARRESTER WITH HOT GAS RELIEF MEANS

BACKGROUND OF THE INVENTION

The present invention relates generally to the transmission and distribution of electrical power, and particularly to power substations of the type having substation components within a metal enclosure pipe containing an insulating gas and in which one of the components in the enclosure pipe is a voltage surge arrester.

Voltage surge arresters are sometimes incorporated inside a metal enclosure pipe of a gas insulated power substation installation. The use of surge arresters in such apparatus is described for instance in the following U.S. Pat. Nos: 3,624,450 issued to H. W. Graybill 30 Nov. 1971 and 3,753,045 issued to Osmundsen et al. 14 Aug. 1973. Further details of such substations are found for example in the technical article entitled Where Land is Scarce and $$ High Consider the $SF_6$ Mini Sub, Transmission and Distribution, December 1973, pages 34–38 and 109.

One problem with arresters incorporated in such a gas insulated installation is presented by the possibility of a violent failure of the arrester. Because the insulating gas in the system, generally sulphur hexaflouride ($SF_6$), is not suitable for the arcing that occurs in an arrester during its operation, arresters, even when enclosed in gas insulated systems, are nevertheless usually provided with a porcelain housing to isolate the internal components of the arrester from the insulating gas in the system. Should such an arrester for some reason fail, so that internal flashover permits a very substantial current flow through it to ground, there would be generated inside the porcelain housing of the arrester a considerable amount of arc-generated hot gas. If this gas is not vented from the inside of the arrester, it can result in a violent fracturing of the porcelain housing, pieces of which may rupture the metal enclosure pipe of the system and possibly pose a hazard to personnel in the vicinity.

Heretofore, there have been provided means for venting such gases generated inside the arrester to the outside of the gas insulated system by, for example, providing a diaphragm at the bottom mounting of the arrester which will rupture under gas pressure to allow the gas to escape to the outside air. Such arrangements are described for example in the above-cited patents. Venting of the gases to the outside air has been thought desirable in order to prevent contamination of the insulating gas inside the system by the arc-generated gases. One difficulty with this approach, however, is that although the gases generated inside the arrester are indeed released through the bottom of the arrester to the outside air, current will continue to be passed through the failed arrester to ground. Under certain internal flashover conditions, the energy absorbed in the arrester in the failure mode is so great that a violent fracture of the arrester porcelain can occur in spite of such venting of gases from the bottom to the outside. Moreover, thermal shock alone can cause fracture of the porcelain and venting of the $SF_6$ to the air. This venting in itself poses a hazard, in that some toxic products are formed by electric arcing in $SF_6$.

SUMMARY OF THE INVENTION

In accordance with the present invention, the arrester is provided with a gas vent inside the system and near the line terminal. The vent directs gases to the inside wall of the metal enclosure pipe.

If the arrester should fail, hot gases generated inside the arrester are vented out though this vent to provide a conductive path between the line terminal of the arrester and the grounded enclosure pipe. This prevents additional energy from being supplied to the arrester itself, and thus prevents a violent fracture of the arrester porcelain.

DESCRIPTION OF THE PREFERRED EMBODIMENT

Figure 1:
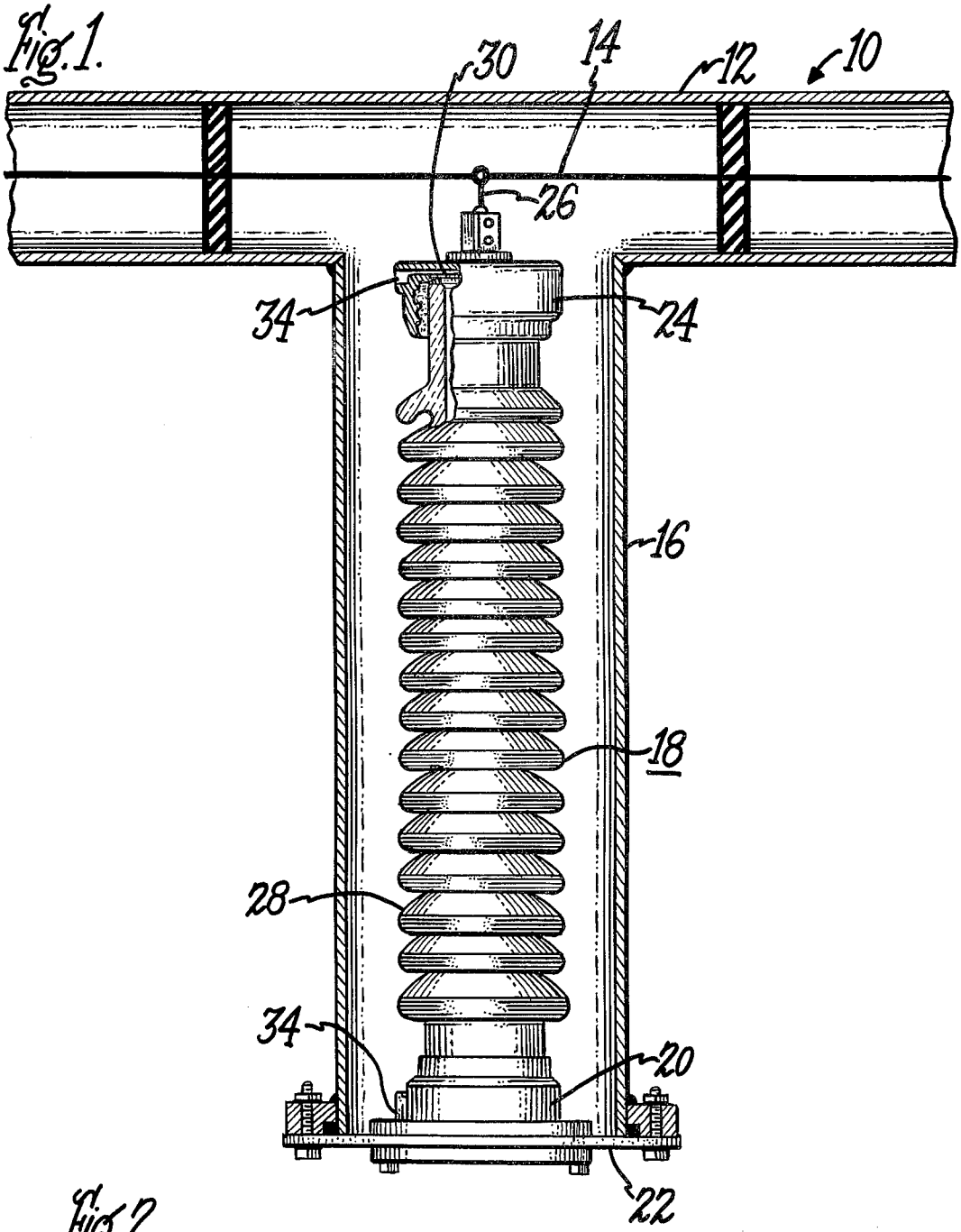
FIG. 1 is a partly cut-away, sectioned view of a portion of a gas-insulated transmission and distribution system containing a voltage surge arrester in accordance with the preferred embodiment of the present invention.

A preferred embodiment of the present invention is illustrated in FIG. 1 of the drawings. Shown in the FIG. 1 is a "T" section 10 of a gas-insulated electrical substation. The section 10 includes an outer, grounded enclosure pipe 12 and an inner, centrally located line conductor 14 which carries the line voltage. The space inside the enclosure pipe 12 is filled with an electronegative insulating gas, such as sulphur hexaflouride ($SF_6$). Inside the vertical pipe member 16 of the "T" section 10 is a voltage surge arrester 18 with a bottom, grounded metal end cap 20 demountably secured to a removable end plate 22 of the pipe member 16 and a top, line terminal end cap 24 attached by a short lead 26 to the line conductor 14. The end caps 20, 24 are essentially similar in structure, but are oriented oppositely at their respective ends of the arrester 18. Between the caps 20, 24 is a porcelain housing 26 enclosing the internal components of the arrester. The porcelain housing 28 and the internal components of the arrester 18 may be of conventional design, and are not discussed in detail herein. The top cap 24 is shown in more detail in FIG. 2, and it is to be understood that the bottom cap 20 is similar.

Figure 2:
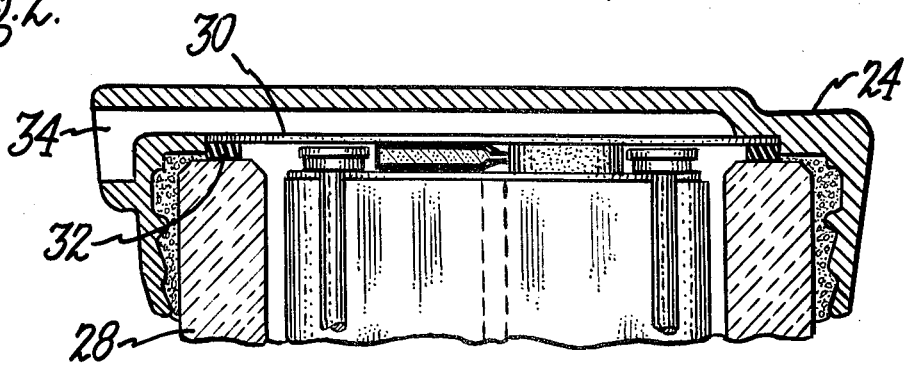
FIG. 2 is an enlarged, sectioned view of the upper end of the arrester of FIG. 1.

Referring now to the FIG. 2, the end of the porcelain housing 28 is sealed by a rupturable metal diaphragm 30 clamped to a sealing gasket 32 by the end cap 24. In order to vent gas from inside the arrester 18 when the diaphragm 30 ruptures, the cap 24 is provided with a vent opening 34 directed perpendicularly to the axis of the arrester 18 toward the nearby inside wall of the grounded enclosure pipe 12.

The gas-generating failure modes of arresters such as the arrester 18 of the preferred embodiment, as well as the resultant venting of the gas through the vent opening 34 are well known to those of ordinary skill in the art of voltage surge arresters and will therefore not be discussed in detail herein. Such operative details are discussed, for example in U.S. Pat. No. 3,518,483 issued to Eason et al. 30 June 1970 and assigned to the same assignee as the present invention. The important consequence of a failure, with attendant gas venting through the vent opening 34, is that the hot, conductive gas is vented inside the enclosure pipe 12 to strike the inside surface of the grounded pipe 12 and result in a direct short circuit for initiating the operation of a protective breaker elsewhere. Since the short circuit thus resulting is at the line terminal end cap 24 of the arrester 18, continuation of current flow through the faulty arrester, with possible fracture of the porcelain 28, is prevented.

The vent at the bottom cap 20 of the arrester 18 is provided merely for additional venting and is not essential to the short circuiting function of the venting, as is the top cap 24.

GENERAL CONSIDERATIONS

In the past, it has been considered undesirable to vent the arc-generated gases from the arrester to the inside of the gas-insulated system, since the arc-generated gas would contaminate the insulating gas inside the housing. However, the contamination of the insulating gas inside the housing is a relatively minor consideration when compared to the more important avoidance of a violent fracture of the arrester porcelain. For one thing, in modern gas-insulated systems various sections of the system are isolated from one another by gas barriers, so that the rupturing of the enclosure pipe or other failure of one section of the system will not generally effect the environment of the other portions of the system. Thus, contamination of the insulating gas in that section of the system containing the surge arrester is not necessarily a serious problem. On the other hand, with prior structures, in which the gas was vented out the bottom of the arrester to the outside air, it could occur that due to the impedance of the failing arrester, the fault current in the internal components of the arrester is not great enough to initiate a protective breaking of the circuit, while still being sufficient to lead to a very rapid absorption of energy by the arrester components through which it passes. In such a case, even with means for venting the gases, the pressure buildup of gases inside can be so fast that violent fracture of the porcelain still occurs. The porcelain can also fracture from just the thermal stresses resulting from rapid heating of the internal components. In either case, the fracture of the porcelain is likely to result in escaping of the insulating gas from that section of the system housing.

With the present invention, the current which would ordinarily pass through the arrester because of the faulty components is immediately shunted to the grounded metal enclosure pipe wall, thus resulting in a direct short circuit. Such a short circuit positively initiates the operation of protective breaker mechanisms of the system to open, and thus isolate, that portion of the system containing the fault. The arrester may now be removed and replaced with an operative arrester, without the metal enclosure having suffered any damage physically due to a breaking of the arrester porcelain and without an accidental venting to the air of any of the toxic arcing products of the $SF_6$ gas inside the system.

Although in the arrester of the preferred embodiment a gas vent was provided at the line terminal cap and the ground terminal cap, it should be understood that where more than one arrester is provided in a stacked arrangement, separate vents may be provided for the ends of each closed portion of the total structure.

While in the arrester of the preferred embodiment the vent was directed to the nearest portion of the metal system wall, it may be that merely venting the gas in any direction in the housing will cause such rapid and sufficient contamination of the insulating gas to result in a desired short circuit at a nearby point between the transmission line and the metal housing wall.

I claim,

1. Electrical power apparatus of the type having a grounded metal enclosure containing an insulating gas and having a voltage surge arrester mounted inside said enclosure, wherein the improvement comprises:

a gas vent provided adjacent the line voltage terminal end of said arrester for venting gases generated inside said arrester, said vent being directed toward, and in close proximity to, the inside surface of said metal enclosure.

* * * * *